United States Patent [19]

Short

[11] Patent Number: 4,911,734

[45] Date of Patent: Mar. 27, 1990

[54] PROCESS FOR MAKING PRINTED ABRASIVE SHEETS

[76] Inventor: William C. Short, P.O. Box 5582, Wilmington, Del. 19808

[21] Appl. No.: 186,611

[22] Filed: Apr. 27, 1988

[51] Int. Cl.[4] ..... D06P 1/02; B44C 1/17

[52] U.S. Cl. ..... 8/471; 156/230; 156/240

[58] Field of Search ..... 8/467, 468, 469, 470, 8/471, 472; 156/277, 230, 234, 238, 239, 240, 241, 249; 101/211, 470; 428/143, 144, 145, 146, 147, 148, 149, 150

[56] References Cited

U.S. PATENT DOCUMENTS

| | | | |
|---|---|---|---|
| 4,021,591 | 5/1977 | DeVries et al. | 156/230 |
| 4,213,926 | 7/1980 | Togoda et al. | 156/240 |
| 4,328,274 | 5/1982 | Tarbatton | 428/145 |
| 4,395,263 | 7/1983 | Davis | 8/471 |
| 4,541,340 | 9/1985 | Peart et al. | 101/470 |

FOREIGN PATENT DOCUMENTS

| | | | |
|---|---|---|---|
| 4026 | of 1880 | United Kingdom | 428/144 |

*Primary Examiner*—Michael W. Ball
*Assistant Examiner*—Louis Falasco
*Attorney, Agent, or Firm*—Connolly and Hutz

[57] ABSTRACT

Disclosed is an abrasive sheet having a design printed thereon. Further disclosed is a process for making such sheets using a sublimation heat transfer printing process. The design is printed onto an abrasive sheet having an abrasive side and; in some embodiments, an adhesive side, by contacting the abrasive side with a sublimation ink transfer sheet at a temperature and for a time sufficient to transfer the sublimation ink from the transfer sheet to the abrasive sheet.

9 Claims, 1 Drawing Sheet

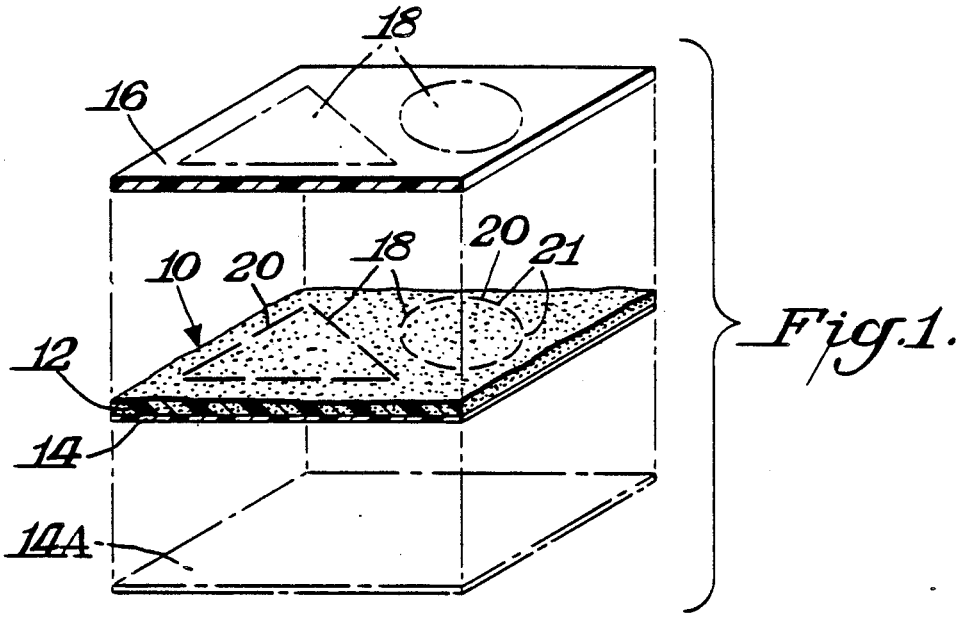
Fig. 1.
Fig. 2.
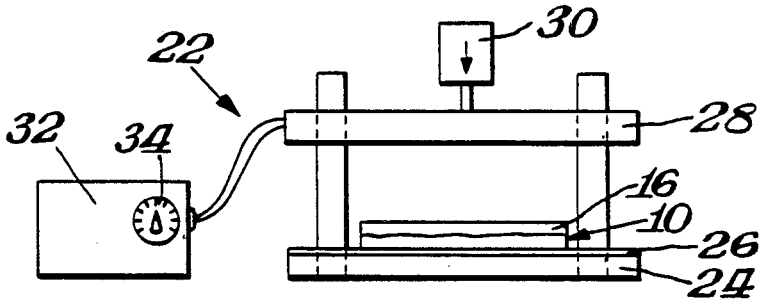

PROCESS FOR MAKING PRINTED ABRASIVE SHEETS

BACKGROUND OF THE INVENTION

1. Field of the Invention

The invention relates to an article of manufacture and a process for making said article. In particular, the invention relates to an abrasive sheet having a design printed thereon and a sublimation heat transfer process for making the same.

2. Description of the Prior Art

Abrasive sheets are known in the art. In particular, abrasive sheets having an adhesive backing have found a wide variety of uses. They find use as appliques wherever an antislip surface is desired. This includes use as gripping tapes applied to stair treads and swimming pools and as appliques applied to the top of skate boards or to the bottom of showers and bathtubs. By the very nature of such uses, the sheets are constantly subjected to wear by their user.

For both safety and aesthetic reasons, it is desirable to be able to print graphic designs on such sheets. Because of the granular or texturized nature of the sheet's surface, this has proven to be a difficult task. For example, by using conventional silk screen printing processes it has not proved economically feasible to make graphics. Instead, with silk screening both the screen and the squeegee are subjected to excessive and rapid deterioration, because of the abrasive nature of the sheets' surface.

Surprisingly, it has been found that it is possible to economically make an abrasive sheet having graphic designs of unlimited color combinations and of considerable detail, which is also long-lasting, by using a sublimation heat transfer process.

SUMMARY OF THE INVENTION

A sublimation heat transfer printing process is used for printing designs on an abrasive sheet. In a preferred embodiment, the sheet contains a first, abrasive side and a second, adhesive side. The design is printed on the abrasive side. The sheet may be cut into a desired shape, either before or after the printing. Similarly, the adhesive may be applied either before or after printing.

BRIEF DESCRIPTION OF THE DRAWINGS

The invention is further explained with reference to the following drawings wherein:

FIG. 1 is an exploded view illustrating a sublimation ink transfer sheet, an abrasive sheet having a design printed thereon and having an adhesive layer and a protective backing and;

FIG. 2 is a schematic illustration of a heat transfer device.

DETAILED DESCRIPTION OF THE PREFERRED EMBODIMENTS

The abrasive sheets 10 useful in accordance with the invention are known in the art. Abrasive sheets having an adhesive side 14 which is protected by a removable protective backing 14A can be obtained, for example, from Wooster Products of Wooster, Ohio, under the trademark "Flex Tread" antislip deck tape and from Minnesota Mining and Manufacturing of St. Paul, Minnesota, under the trademark "Safety Walk", antislip surface material. They contain a first, abrasive side 12 and a second, adhesive side 14. The abrasive side is characterized by a granular or texturized surface. Typically, such sheets are laminates having a first side which is flexible polymeric binder containing inorganic abrasive granules, such as silica (sand), cullet (glass) or aluminum oxide particles and a second side which is treated with an adhesive, such as an acrylic adhesive. The choice of a particular abrasive sheet will depend upon its end use. For example, where the sheets are to be applied to the top of skate boards, a premium is placed upon durability. Preferrably, such sheets are flexible. Further, it has been found that the best results are obtained when the sheet is white and the abrasive granules are transparent.

Sublimation printing processes are also generally known in the art, especially for use on garments and other cloth articles. See, for example U.S. Pat. No. 4,021,591 which is incorporated herein by reference. Sublimation printing involves the transfer under heat and pressure of one or more sublimation inks from a sublimation transfer onto the article to be printed. The processes may be used to transfer virtually any desired graphic design which includes artwork, logos or lettering.

The sublimation transfer includes a backing sheet 16, the backing sheet having deposited thereon a sublimation transfer design layer containing a design 18 formed of one or more sublimation transfer inks. The sublimation transfer is applied to the article to be decorated under heat and pressure with the backing sheet so that the design contacts and is transfered to the article.

The heat transfer may be accomplished using a heat transfer device 22 comprising a heat resistant bottom platen 24, and a top heating element 28. The bottom platen preferrably has a heat resistant rubber cover 26. The top heating element is preferrably equipped with means for applying consistant pressure 30 and means for applying consistant temperature 32, most preferrably with thermostatic controls 34.

In preferred embodiments, the sublimation transfer is placed ink-side down on an abrasive sheet having a preapplied adhesive layer and a protective backing, which has been placed on the bottom platen, abrasive side up. The heating element is then applied for a time and at a temperature and pressure sufficient to transfer the ink. Representative times range from about 10 to about 60 seconds, typically about 20 seconds. Representative temperatures range from about 120° to about 230° C., typically about 190° C. Temperatures which are too low or times which are too short, may result in incomplete volatization of the sublimation ink and there will not be a complete transfer to the abrasive sheet. Conversely, temperatures which are too high or times which are too long, may result in warping of the adhesive sheet and bleeding of the sublimation ink. The particular combination of temperature, time and pressure to be used with a specific combination of sublimation transfer an abrasive sheet will be readily determinable by one skilled in the art without undue experimentation. After the transfer, the heating element is raised, the sublimation transfer is removed from the abrasive sheet and the abrasive sheet is removed from the platen to cool, preferrable on a flat, dry surface.

In some embodiments, the abrasive sheet 12 is cut into desired shapes 20. This may be done before or after the design has been printed on the abrasive sheet. In preferred embodiments, it is cut with a die.

In a most preferred embodiment, the abrasive sheet contains a preapplied, self-adhesive second side 14. The second side is backed by a protective layer 14A which is not removed until the sheet is finally applied, e.g., to the top of a skate board. In a first step, the sheet is cut with a die into the desired shape with hang-ons 21. By "hang-ons" is meant a portion of the sheet, e.g. an approximately one-eighth inch strip, which is left connecting the periphery of the design to the remainder of the original sheet. The hang-ons are formed from thin spaces in the die rule. The hang-ons allow the various die cut shapes to remain intact until they are deliberately snapped apart. In a second step the pre-cut sheet is subjected to a sublimation heat transfer process that applies one or more sublimation inks to the sheet in colors and patterns that correspond to the die-cut shapes. In other embodiments, the adhesive may be applied to the nonprinted side after printing and either before or after cutting into a desired shape.

Having generally outlined the details of the invention, the following, non-limiting example provides more specific details to the invention.

A printed, adhesive sheet having an adhesive side was made in accordance with the invention. The heat transfer device, manufactured by Hix Corporation, Pittsburg, Kansas, had a heat resistant, cushioned bottom platen and a variable heat and pressure top platen capable of applying a predetermined temperature and pressure.

The heat transfer device was preheated to a temperature of 196° F. A sheet of 10"×10" #1 tissue paper was placed on the bottom platen, to prevent any adhesive that may be displaced from the abrasive sheet from contacting the bottom platen. (The tissue paper may also serve to prolong the life of abrasive sheets having intricate and multiple die cuts by preventing premature detachment and excessive damage and warpage due to mishandling or storage). A white 10"×10" abrasive sheet having an adhesive side, manufactured by Wooster, Products, Wooster, Ohio, under the Trademark "Flex-Tred", antislip deck tape, was placed on top of the tissue paper, with the abrasive side up. A pre-cut, 10"×10" sublimation transfer, printed by Lehigh Press of Pennsauken, New Jersey, was placed ink side down on top of the abrasive sheet, so that the graphic of the sublimation transfer corresponded with the die cuts of the abrasive sheet.

The heated top platen was lowered onto the bottom platen and the abrasive sheet subjected to a temperature in excess of 196° F., for 30 seconds at a pressure sufficient to affect complete transfer of the sublimation inks to the abrasive sheet without bleeding or warpage. The top platen was then lifted and the abrasive sheet removed to a flat, clean surface and cooled to room temperature.

I claim and desire to protect by Letters Patent:

1. A process for printing a design onto an abrasive sheet comprising:

(a) providing an abrasive sheet having a first abrasive side with inorganic abrasive material attached thereto, (b) contacting said abrasive side with a sublimation ink transfer sheet, (c) applying heat at a temperature and for a time such that the sublimation ink is transferred from said transfer sheet to said abrasive side and (d) removing said transfer sheet from contact with said abrasive side.

2. The process of claim 1 further comprising the abrasive sheet has a second adhesive side.

3. The process of claim 1 further comprising the abrasive sheet is white with transparent abrasive granules.

4. The process of claim 1 wherein the time is from about 10 to about 60 seconds.

5. The process of claim 1 wherein the temperature is from about 120° to about 230° C.

6. The process of claim 1 further comprising the abrasive sheet is placed abrasive-side up onto a temperature resistant platen, a sublimation ink transfer sheet is then placed ink-side down on the abrasive side of the abrasive sheet, a heating element is then applied to the sublimation ink transfer sheet for a time and at a temperature and pressure sufficient to transfer the sublimation ink from the substrate to the abrasive side, the heating element and the substrate are first removed and then the substrate is removed and cooled.

7. The process according to claim 6, further comprising the abrasive sheet is white with transparent abrasive granules.

8. The process of claim 6 further comprising that prior to placement onto the temperature resistant platen, the abrasive sheet is cut with a die into a shape having hang-ons.

9. A process according to claim 2 wherein said inorganic abrasive material is in the form of granules or particles.

* * * * *